United States Patent [19]

Gabrielidis

[11] 4,180,262

[45] Dec. 25, 1979

[54] TENNIS SERVING TOSS AID

[76] Inventor: Pericles Gabrielidis, 13643 Hatteras St., Van Nuys, Calif. 91401

[21] Appl. No.: 878,303

[22] Filed: Feb. 16, 1978

[51] Int. Cl.[2] ..... A63B 69/38

[52] U.S. Cl. ..... 273/29 A

[58] Field of Search ..... 273/29 R, 29 A, 96 R, 273/97 R, 67 C, 26 B, 72 R, 72 A, 84, 193, 194, 106 B; 124/5

[56] References Cited

U.S. PATENT DOCUMENTS

| | | | |
|---|---|---|---|
| 4,253 | 2/1871 | Codding, Jr. | 63/3 |
| 2,086,493 | 7/1937 | Ellingwood | 63/3 |
| 3,521,883 | 7/1970 | Hamilton | 273/26 B |
| 4,034,981 | 7/1977 | Veneziano | 273/29 A |

*Primary Examiner*—Richard C. Pinkham
*Assistant Examiner*—T. Brown
*Attorney, Agent, or Firm*—Allan M. Shapiro

[57] ABSTRACT

The tennis serving toss aid is a ring which is held in the fingers of the tennis ball tossing hand. The ball to be served rests freely in the ring and against the hand. The tennis serving toss aid positions the fingers for correct tennis ball tossing for serving, and helps to train the user in both the proper procedures for tossing the ball and also the avoidance of the common mistakes and improper procedures for doing so.

5 Claims, 4 Drawing Figures

TENNIS SERVING TOSS AID

BACKGROUND OF THE INVENTION

1. Field of the Invention

This invention is directed to a tennis serving toss aid which not only teaches the correct positioning of the fingers in the tennis ball tossing hand but also forces the tosser to avoid those improper procedures which detract from optimum tossing of the tennis ball into serving position where it is engaged by the racket for the serve.

2. Description of the Prior Art

The correct serving of a tennis ball requires that the ball be tossed into the correct position to be engaged by the racket. This correct position must be an accurately repeatable position. The ball is tossed into that serving position by the hand opposite to that which holds the tennis racket. Experience has shown that certain procedures with the tossing hand are desirable to achieve this repeatable toss of the tennis ball, and other procedures should be avoided for this purpose. For example, the fingers should neither engage, grasp nor support the ball but rather merely form a cup so that the ball rests freely on the palm of the hand. The fingers should neither aid nor interfere with the toss and release of the ball, and not impart a spin to the ball. The palm of the hand should be held facing upwardly throughout the toss to avoid an angular or spinning toss. The wrist should not bend backwardly toward the server, which would have a tendency to cause the ball to come back over the server's head. Previously to the present tennis serving toss aid, no device has been available for teaching the positioning of the fingers, hand and wrist to achieve the requisite toss for optimum serving.

SUMMARY OF THE INVENTION

In order to aid in the understanding of this invention, it can be stated in essentially summary form that it is directed to a tennis serving toss aid which comprises a ring which has an opening therein to freely receive and release a tennis ball and which is shaped so that holding of the ring in the fingers teaches the optimum hand and finger positioning for tossing a tennis ball in the serve thereof.

It is thus an object of this invention to provide a tennis serving toss aid which teaches the correct finger and hand positioning for the optimum tennis ball toss during serving. It is a further object to provide a teaching aid in the form of a ring which is held in the fingers to teach the correct finger and hand position for tossing the tennis ball in the serve thereof. It is another object to provide a teaching aid which is inexpensive and easy to use so that the teaching aid is available to many who can benefit from the use thereof.

The features of the present invention which are believed to be novel are set forth with particularity in the appended claims. The present invention, both as to its organization and manner of operation, together with further objects and advantages thereof, may be understood best by reference to the following description taken in conjunction with the accompanying drawings.

DESCRIPTION OF THE PREFERRED EMBODIMENT

Figure 1:
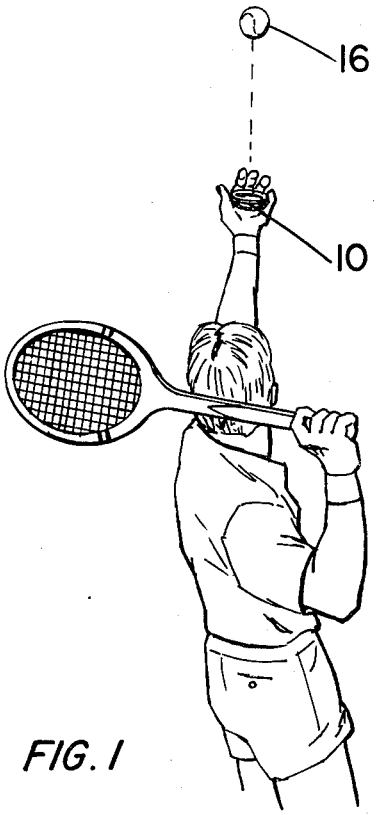
FIG. 1 is a rear elevational view of a tennis player employing the tennis serving toss aid of this invention.
Figure 2:
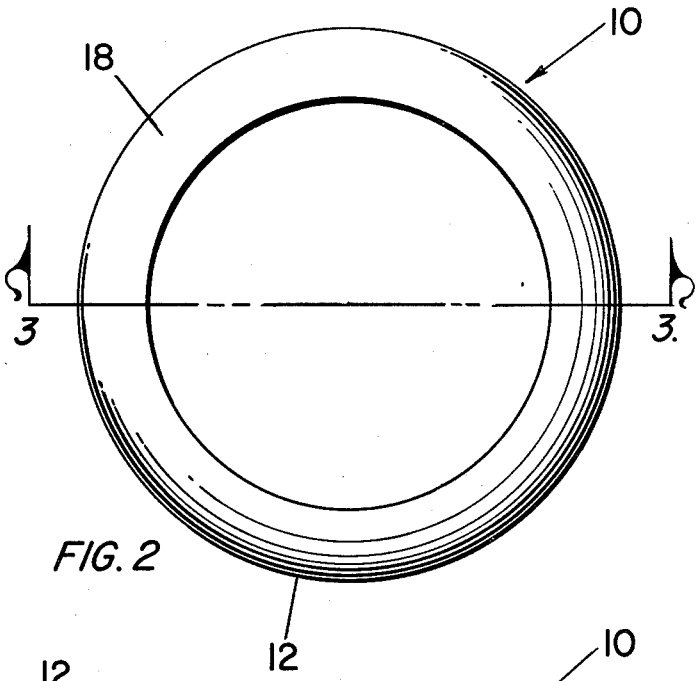
FIG. 2 is a plan view of the tennis serving toss aid of this invention.

The tennis serving toss aid of this invention is generally indicated at 10 in each of the figures of the drawing. The aid 10 is a ring 12 which is formed with the interior surface preferably in the form of a right circular cylinder. The interior surface preferably has a diameter of $2\frac{3}{4}$ inches to loosely receive a tennis ball such as the tennis ball 16.

Figure 3:
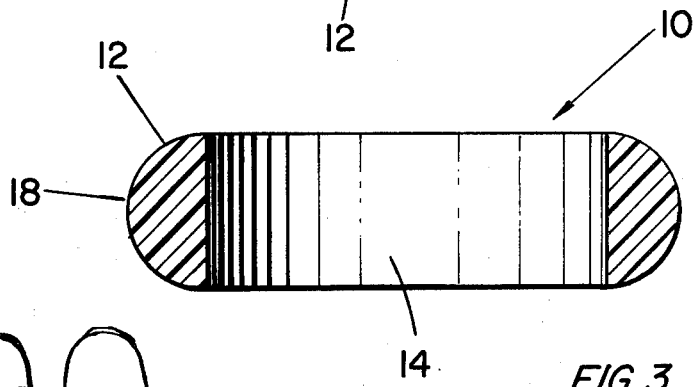
FIG. 3 is a section taken generally along the line 3—3 of FIG. 2.
Figure 4:
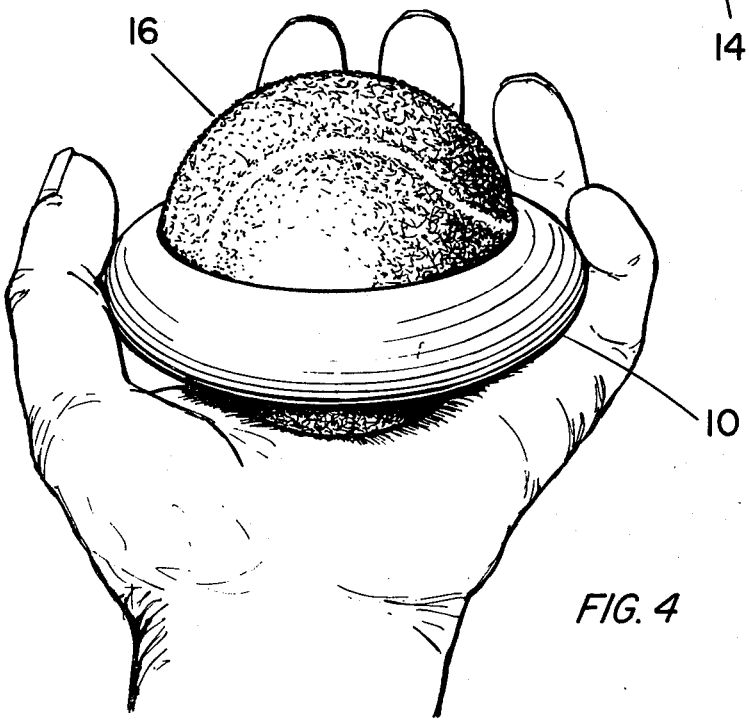
FIG. 4 is a perspective view of the tennis serving toss aid of this invention shown in the left hand of the tennis player and as seen from the eyes of the tennis player.

While the outer surface 18 may be of any convenient surface to be held in the fingers, the preferred shape of the ring 12 is toroidal with the closed curve forming the toroid being a half circle and with the diameter of the half circle forming tne inner surface 14. Thus, the outer surface 18 is a smooth curve which, when taken in section, is in the form of a hemicircle as shown in FIG. 3. The height of the ring 12 is the diameter of the hemicircle and is preferably about 1 inch for convenient holding by the fingers and positioning of the fingers.

The preferred material of aid 10 is synthetic polymer composition material. Modern thermoplastic materials can be employed to achieve a structure for the aid 10 which will retain its shape and yet will be of inexpensive character so that it may be widely used and will have a long life. Furthermore, selected ones of the polymer composition materials will be sufficiently smooth to permit smooth release of the ball and yet will have an outer surface by which the fingers can retain the aid without tight grasping thereof. Thus, thermoplastic synthetic polymer composition materials are the preferred materials.

In use, the aid 10 is held in the fingers of the hand. The right-handed tennis player illustrated in FIG. 1 carries his racket in his right hand and carries the aid 10 in his left hand. The aid is grasped in the fingers with the fingers extending generally upright in a direction parallel to the axis of the aid, which is the center line about which the inner surface 14 is shaped. The aid is held in the fingers from the second finger joint outward and is not grasped, but is held lightly in the fingers. In this position, the fingers define an open cup extending up from the palm of the hand.

In using aid 10, ball 16 is then placed within the aid for the toss of the ball. The arm is moved upward and forward to toss ball 16 into the serving position. The thrust of the arm forward and upward tosses the ball to the location where the player can hit the ball with his racket for the serve. This location must be accurately repeated so that tennis serving is accurately repeated.

Without the aid, the server might make one or more of the common mistakes which cause the ball to be tossed in a generally uncontrollable and certainly non-repeatable manner. Such mistakes or erroneous procedures include flipping the ball with the fingers, turning and/or rotating the palm during the toss, bending the wrist so that the hand flips the ball backwardly toward the server as with wrist snap, and generally failing to lift the hand high in a smooth continuous motion so that the server fails to achieve the desired effect of pushing the ball up and forwardly into the desired location for the optimal serve.

With the aid, the foregoing errors either are impossible to make or else their occurrence causes the ball to be tossed so wildly and/or erratically as to fail completely to achieve the desired position, thus dramatically calling the server's attention to the error of his ways so that he can concentrate on the proper motion. It will be noted that most of the errors in procedure are due to the use of the fingers for engaging the ball and attempting to compensate for the other errors in procedure; the aid prevents such unreliable compensatory procedures.

Repeated use of aid 10 trains the player to hold his hand, wrist and fingers in the optimum and correct position. Aid 10 is a training aid and is used in serving practice. It forces the server to avoid using his hand, wrist and fingers in an improper manner and position for proper tossing. When the proper position training is achieved by the aid 10, then, in actual play, the player does not use aid 10. Instead, the fingers are trained to extend upward from the palm to form a cup within which the ball rests without engaging of the ball and the proper hand, wrist and finger position and movement training for the toss is achieved.

The previously described dimensions and shape of the aid 10 are regarded as optimum for the average hand because they provide for guided release of the ball upwardly when the hand is properly positioned and moved while preventing the fingers from departing from their cup-like position and undesired finger contact with the ball.

This invention having been described in its preferred embodiment, it is clear that is is susceptible to numerous modifications and embodiments within the exercise of the inventive faculty. Accordingly, the scope of this invention is defined by the scope of the following claims.

What is claimed is:

1. A tennis serving toss aid comprising:

a ring;

interior wall defining a circular interior opening, said opening being two-and-three-quarters inches in diameter to closely receive a tennis ball and prevent wobble of said ball within said ring and to permit a tennis ball to extend down through the opening so as to rest upon the palm of the hand and initially guide said ball during its release; and said ring further including an exterior surface means for holding in the tossing hand of a tennis player, said external surface being for holding the fingers in a tennis serving toss position in which the fingers are positioned like a cup and out of engagement with a tennis ball while the tennis ball rests on the palm of the hand.

2. The aid of claim 1 wherein said interior surface is a circular cylinder about a central axis of said aid.

3. The aid of claim 2 wherein said external surface is a surface of revolution around said axis.

4. The aid of claim 3 wherein said external surface of revolution is half circular in section.

5. The method of training a tennis player for a tennis serving toss comprising the steps of:

positioning a tennis serving toss aid on the palm of the player's serving toss hand, said aid comprising a ring having an interior opening for freely receiving and permitting the release of a tennis ball and having an outer surface for holding in the fingers of such toss hand; and placing a tennis ball in the ring so that the ball rests upon the palm of the hand through the ring; and tossing the tennis ball from the hand and from the ring to train the finger positions and the hand and wrist motions for proper tennis serving toss and repeating the toss utilizing the ring until the fingers, hand and wrist are trained in the proper serving toss positions and movements.

* * * * *